United States Patent [19]

Durville et al.

[11] 4,159,558

[45] Jul. 3, 1979

[54] APPARATUS FOR THE CUTTING OF COLUMNS OF THREAD LOOPS

[75] Inventors: Gerard Durville, Le Lignon; Michel Moulin, Lausanne; Serge Ramseier, Carouge; Erwin Zurcher, Le Lignon, all of Switzerland

[73] Assignee: Cotonificio Cantoni S.p.A., Milan, Italy

[21] Appl. No.: 844,278

[22] Filed: Oct. 21, 1977

Related U.S. Application Data

[63] Continuation-in-part of Ser. No. 836,094, Sep. 23, 1977, abandoned, which is a continuation of Ser. No. 641,365, Dec. 17, 1975, abandoned.

[30] Foreign Application Priority Data

Dec. 24, 1974 [CH] Switzerland ..... 17270/74
Oct. 22, 1976 [CH] Switzerland ..... 13365/76

[51] Int. Cl.[2] ..... D06C 13/08; D06C 13/10
[52] U.S. Cl. ..... 26/10 R; 26/13
[58] Field of Search ..... 26/8 R, 8 C, 9, 10 R, 26/10 C, 13, 14; 219/121 L, 121 LM

[56] References Cited

U.S. PATENT DOCUMENTS

| | | | |
|---|---|---|---|
| 3,634,646 | 1/1972 | Berger | 219/121 L |
| 3,679,863 | 7/1972 | Houldcroft | 219/121 LM |
| 3,742,183 | 6/1973 | Castro et al. | 219/121 L |
| 3,749,878 | 7/1973 | Sullivan et al. | 219/121 L |
| 3,877,119 | 4/1975 | Gierse et al. | 26/9 |
| 3,925,864 | 12/1975 | Gilpatrick | 26/9 |
| 3,977,055 | 8/1976 | Gilpatrick | 26/9 |
| 3,977,056 | 8/1976 | Gilpatrick | 26/9 |
| 3,982,309 | 9/1976 | Gilpatrick | 26/9 |
| 4,065,837 | 1/1978 | Gierse et al. | 26/9 |

FOREIGN PATENT DOCUMENTS

| | | | |
|---|---|---|---|
| 2250289 | 4/1974 | Fed. Rep. of Germany | 219/121 LM |
| 45-20158 | 7/1970 | Japan | 26/8 R |
| 297974 | 10/1928 | United Kingdom | 26/8 R |
| 615806 | 1/1949 | United Kingdom | 26/8 R |

*Primary Examiner*—Robert Mackey
*Attorney, Agent, or Firm*—Karl F. Ross

[57] ABSTRACT

A pile fabric, especially velvet, can have a selection of yarn strands appearing on one of its faces severed by means of a focused laser beam. According to the invention, the zone of focus of the laser beam is brought successively into contact with predetermined portions of each of the strands for a period of time sufficient to cause combustion of at least some of the fibers forming each strand. The invention provides means for shifting the focus of the laser beam accordingly.

9 Claims, 10 Drawing Figures

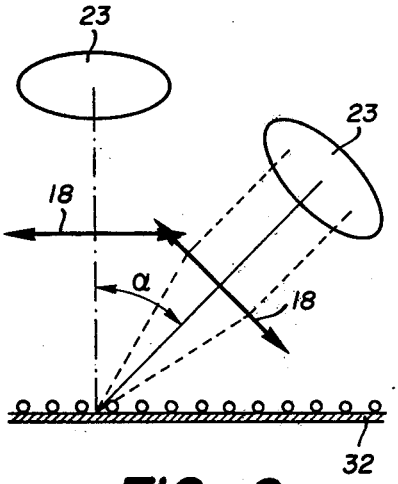
FIG. 6
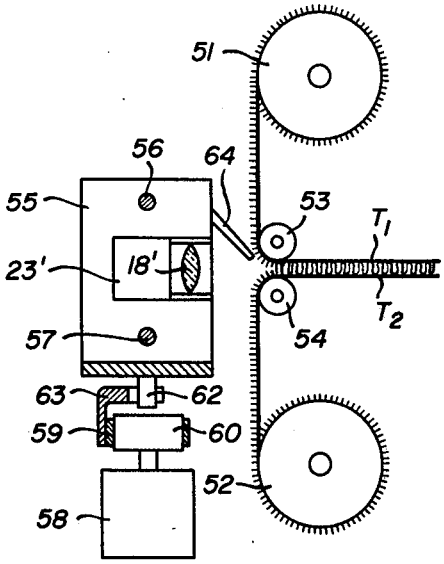
FIG. 8
FIG. 7
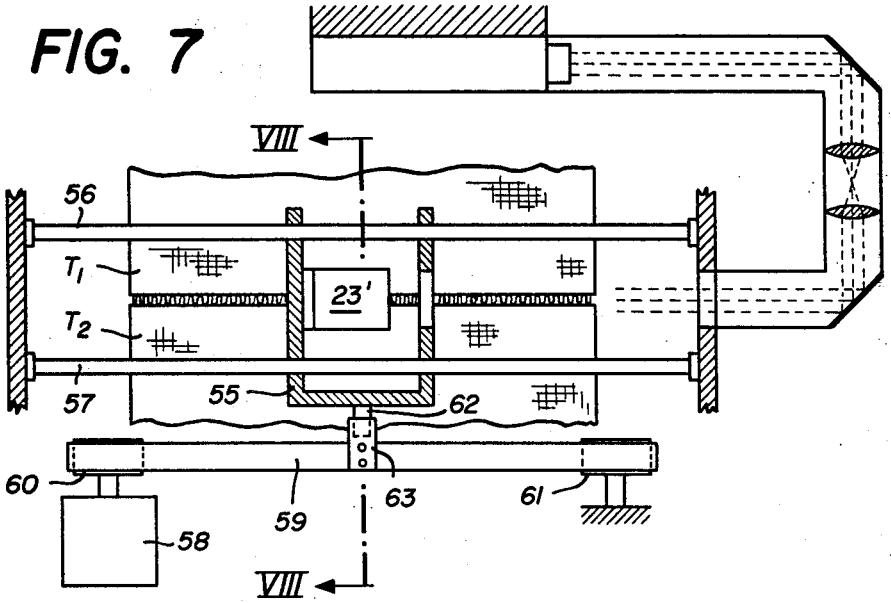

APPARATUS FOR THE CUTTING OF COLUMNS OF THREAD LOOPS

CROSS-REFERENCE TO RELATED APPLICATION

This application is a continuation-in-part of application Ser. No. 836,094 filed Sept. 23, 1977, a continuation of Ser. No. 641,365 filed Dec. 17, 1975 (both now abandoned).

FIELD OF THE INVENTION

The present invention relates to an apparatus for the cutting of thread loops, and more particularly, for the cutting of thread-loop columns of floats and the like in the production of velvet.

BACKGROUND OF THE INVENTION

The cutting of yarn strands bonded to a fabric sheet is required in the manufacture of various pile fabrics. Among these may be mentioned in particular, velvet, a combination known commercially as VELCRO and comprising a hooked fabric for fastening to a looped fabric, and certain machine-manufactured carpets. In each case, the cutting of these strands results in considerable knife wear.

It has recently been proposed to use a laser beam for cutting determined portions of yarn strands to form hooks on a band of looped fabric of approximately 5 cm in width. Two variations of the proposed solution are envisaged. One of these variations consists of transmitting a laser beam transversely to the band of fabric, focused in the contral zone of the band at any given instant to cut one of the branches of the loop. The other of these variations consists of directing the laser beam in the direction of the band and interposing a perforated mask to allow only part of the beam to pass. The results obtained by these processes are very poor because a large part of the energy of the laser beam is lost, so that in the case of plastic (synthetic resin) material the yarn is cut by fusion rather than by combustion. Consequently, the cut is not clean and the efficiency is very low. Moreover, such processes are suitable only for a very narrow band and are consequently unusable for wider fabrics such as those produced for garment manufacture, such as velvet.

The cutting of a piece of fabric to obtain velvet constitutes one of the most delicate operations in the manufacture of this material. In the case of the finest velvets, this operation is carried out with the aid of a knife fixed to a guide engaged in a column of fabric races or "floats."

These columns consist of yarn strands disposed as transverse loops aligned to form columns or ribs which are disposed side by side on one surface of the fabric web. An endless band is formed by sewing the two ends of one piece of fabric in such a manner that the end of each column coincides with the end of an adjacent column, the knife is introduced at one end of a continuous column so formed, and the fabric band is made to move along so that all the transverse strands are cut. This is repeated until all the columns of races have been cut. This operation involves about twenty hours of work for a piece of a size 300 meters × 0.070 meters. The normal wear of the knife sometimes causes the loss of the piece of fabric, or at best, its sale as a remnant. In this respect, a knife change during the cutting of any one piece of fabric leads to an apparent modification of the velvet reflection. The resultant loss of value is considerable.

This method of cutting velvet also suffers from not being able to be used in the cutting of synthetic yarn, so that nearly all the velvet at present produced in this manner is cotton, the knives used being unsuitable for cutting a piece of synthetic fabric. In addition to these disadvantages, the use of a knife constitutes an obstacle to increase of cutting speed, which is limited to between 3 and 5 meters/second.

The above-identified applications describe an apparatus capable of severing thread loops disposed in parallel columns side by side on one of the faces of a fabric web in which the severing operation is effected by means of a laser beam. Essentially, this apparatus comprises guide means constituted by a needle adapted to pass through the thread loops of a column and rigid with a support, means for guiding the support substantially transversely to these columns, a lens for focusing the laser beam fixed on the support and having a focal point located along the guide needle and drive means for relatively displacing the laser beam and the loops forming the aforementioned column.

In this system, while considerable energy of the laser beam is conserved, it has been found that there is nevertheless a loss of energy. Generally, speaking, the thread loops, for the formation of velvet, i.e. the so-called floats of velvet, are formed by the weft threads. Consequently, the thread loops to be cut are spaced from one another by a distance which is approximately equal to the thickness of the thread to be cut.

When the columns of thread loops are displaced along the needle to the laser beam focal point, therefore, the individual loops are spaced apart and aproximately half the laser beam's energy is lost. This loss of laser beam energy corresponds to the time during which the laser beam is trained upon a bare spot of the needle, i.e. the time between passages of the thread loops into the focal point. As a result, the needle is subjected at a fixed point to considerable laser beam energy and tends to become weakened and to break.

OBJECTS OF THE INVENTION

An object of the present invention is to at least partly remedy the disadvantages of the aforementioned solutions.

Another object of the invention is to provide an improved method of cutting thread loops, particularly in the production of velvet, whereby clean, reproducible and well-defined cutting is carried out.

Another object of the invention is to provide an apparatus for the production of pile fabric and particularly for the severing of a column of yarn loops thereof, e.g. in the formation of velvet, which avoids the disadvantages of earlier apparatuses.

It is yet another object of this invention to advance the principles set forth in the above-identified copending applications.

BRIEF DESCRIPTION OF THE INVENTION

To this end, the present invention firstly provides a process for severing a selection of yarn strands appearing on one of the faces of at least one sheet of fabric, in which the severing is performed by means of a focused laser beam. According to the invention, the zone of focus (focal point) of the said beam is brought successively into contact with a determined portion of each of the said strands, on each occasion for a period of time sufficient to cause combustion of at least part of the fibers forming the strands.

The present invention also provides a device for carrying out the process, the device comprising guide means for successively placing the zone of focus of the beam into contact with the determined portions of said strands, and drive means for moving the focus of the beam relative to the said determined strand portions.

According to yet another feature of the invention, a jet of fluid is directed into the region of the focal point of the laser beam, i.e. onto the spot along the needle at which the laser beam is focused.

According to the invention, moreover, guide means can be provided for successively disposing the focal point of the beam in contact with predetermined portions of the yarn strands, drive means being provided for moving the focus of the beam relative to these predetermined strand portions. When several parallel columns of strands are disposed side by side on the surface of a fabric web, the guide means consists of a needle for engagement in one of the columns and rigid with a support, means for guiding the support transversely of the columns and a lens for focusing the beam. The lens is fixed on the support and the focus of the lens is located substantially at the needle.

The problem of avoiding needle wear is solved, in accordance with the present invention, in an apparatus for severing the thread loop columns disposed side by side on one of the faces of the fabric web with a laser beam and the means described above. In addition, the guide needle is formed with hook means for retaining the parallel thread loops forming the column on the needle and adapted to engage the thread loops in response to the relative displacement between the needle and the column, thereby disposing the thread loops successively in a crotch located substantially at the focal point of the laser. The support is formed with an abutment for determining the longitudinal position of the needle.

According to yet a further feature of the invention, the guide needle is mounted on the support by the intermediary of a sliding element. Elastic means is provided to apply to this sliding element a force urging same against the abutment and sufficient to resist the normal force exerted on the needle by the relative movement of this needle and the column of parallel thread loops. This sliding element is connected to an ejection arm maintained in an inactive position by a latch connected to two disengaging elements. One of these disengaging elements is constituted by a cam provided on the slider and associated with a cam follower rigid with the latch. The other disengaging element is controlled by an electromagnet operated, in turn, by a photoelectric cell trained upon the part of the needle which coincides with the focal point of the aforementioned laser beam.

The hook means preferably is covered by a protective coating adapted to resist deterioration by the laser beam. A preferred coating is bright nickel.

BRIEF DESCRIPTION OF THE DRAWING

The above and other objects, features and advantages of the present invention will become more readily apparent from the following description, reference being made to the accompanying drawing in which:

FIG. 6 is a very diagrammatic representation of a modified detail of the first embodiment;

FIG. 7 is an elevation of a device for accomplishing a second embodiment of the method of the invention;

FIG. 8 is a sectional view on the line VIII—VIII of FIG. 7;

SPECIFIC DESCRIPTION

Figure 1:
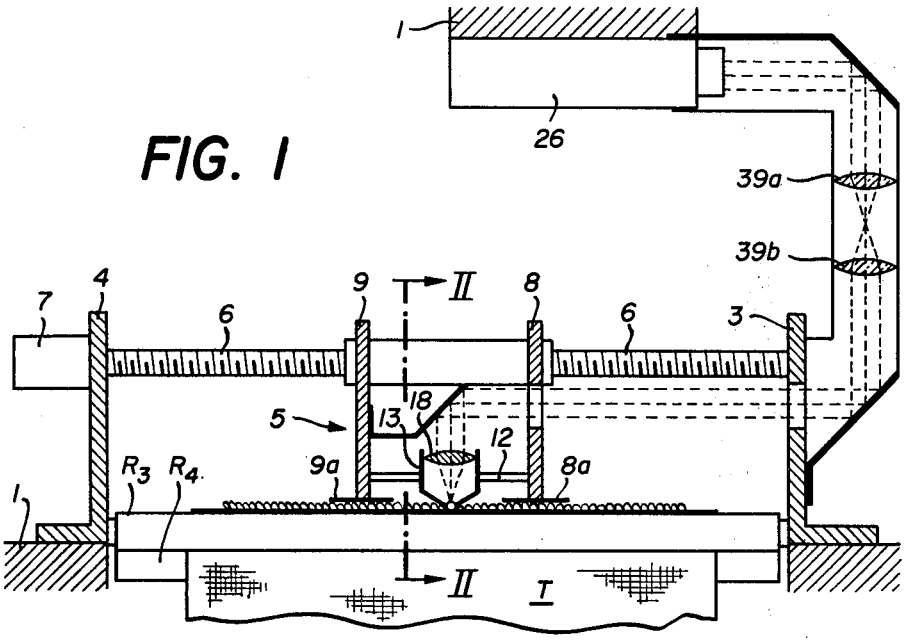
FIG. 1 is an elevational view of a device for carrying out one of the methods of the invention.

FIG. 1 is a very diagrammatic illustration of a cutting device for columns of races of a fabric T to obtain velvet. This device is mounted on the frame of a well known machine designed to drive an endless band of fabric. This machine is shown only by its frame 1 without the drive mechanism for the band of fabric, as this mechanism does not fall within the scope of the present invention. It is sufficient for its understanding to note that the direction of movement of the fabric is perpendicular to the plane of FIGS. 1 and 3, and is in the direction of its warp, although this example must in no way be considered limiting as the process described is equally applicable to the case in which the races are cut in the weft direction.

A pair of parallel tubular rails 2 (FIGS. 2 and 3) is fixed to the machine frame 1 by two lateral uprights 3 and 4 (FIG. 1). This pair of rails carries a slidably mounted carriage 5 controlled by a worm 6 (FIGS. 1 and 2) driven by a pneumatic motor 7 (FIG. 1). The carriage 5 is formed from two side plates 8 and 9 assembled with a certain gap therebetween by means of cross bars 10 and bolts 11. As shown in particular in FIG. 2, the fabric band T is gripped between two pairs of rollers R1, R2 and R3, R4, respectively. These rollers form the drive rollers for the fabric T and their respective speeds are chosen in such a manner that the drawing rollers R1, R2 rotate slightly faster than the tensioning rollers R3, R4, so as to produce a tension in the fabric T and so hold it against the shoes 8*a*, 9*a*.

The carriage 5 also comprises a pair of parallel tubular rails 12 which serve to guide a second carriage 13 kept in a mean position by two very weak centering counter springs 14 and 15 which operate in compression between the side pieces 8 and 9, respectively, and the parallel neighbouring edge of the second carriage 13. As a modification, these springs could be eliminated as will be seen hereinafter. The position of the carriage 13 is detected by a fluid detector in the form of a block 16 with a milled slot 16*a* in which a screen 17 rigid with the carriage 13 engages. A discharge aperture is provided in the rim 16*b* of the detector 16 and a receiving aperture is formed opposite the discharge aperture in the rim 16*c* of the detector. The quantity of air received by the receiving aperture is a function of the penetration of the screen 17 in the slot 16*a*, and consequently of the position of the carriage 13 relative to the carriage 5. The processing of this signal will be explained hereinafter.

The second carriage 13 carries a convergent lens 18 located on the axis of one of the branches 19 of a T duct 20 (FIG. 2), the horizontal branch 21 of which is held between the side plates 8 and 9 of the carriage 5. This horizontal branch 21 is connected to an opening 22 in the side plate 9. A mirror 23 disposed at the intersection of the branches 19 and 21 and at 45° to their respective axes is fixed to the side plate 8 by a support 24 and two bolts 25. The horizontal branch 21 and opening 22 are aligned along the axis of a laser beam produced from a laser 26 and transmitted by two mirrors 27 and 28 (see FIG. 1) by way of two lenses 39*a* and 39*b*. The characteristics of the laser used will be discussed hereinafter.

A nozzle 48 connected to a source of pressurized fluid (not shown) directs a jet of this fluid into the focus zone of the lens 18.

The carriage 5 also comprises a guide and safety mechanism consisting of an arm 29 of U section, rotatable about a rod 30 and stressed by a tension spring 31. The free end of this arm carries a guide 32, a disengagement cam 33 and a stop 34 for a reference spring 35 fixed to the second carriage 13.

This cam is engaged between the branches of the U cross-section of the arm 29 and is retained by a peg 29*a* engaged in an oval through aperture 33*a* in the cam. The thickness of this cam is less than the distance separating the two parallel branches of the U cross-section of the arm 29. Consequently, the cam 33 and guide 32 have two degrees of freedom with respect to the arm 29, laterally and longitudinally. The cam 33 comprises a further two lateral guides 33*b* designed for engagement in an aperture between two guides 13*a*, and 13*b* seen in particular in FIG. 3. A bar 36 is pivoted to the first carriage 5 and comprises at one end a stop tooth 37 and at the other end a cam follower 38 consisting of a roller.

Figure 4:
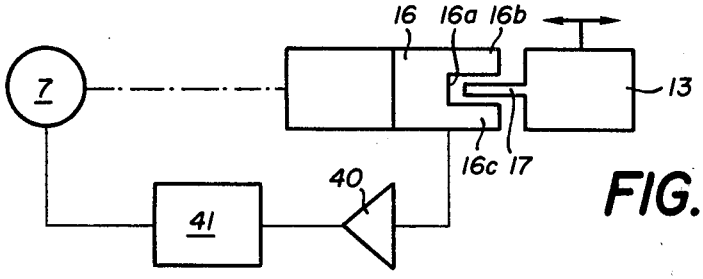
FIG. 4 is a block diagram of a fluid control circuit for an apparatus according to the invention.

It has been stated heretofore that the position of the carriage 13 is detected by the detector 16. The pressure signals measured downstream of the receiving aperture in the rim 16*c* are characteristic of the depth of penetration of the screen 17 in the slot 16*a*. This receiving aperture in the rim 16*c* (FIGS. 4 and 5) is connected to the inlet of an operational amplifier 40, the amplified signal of which operates an analogue servovalve 41 which controls the pneumatic motor 7 driving the carriage 5 in one direction or the other by means of the worm 6 in such a manner as to re-center the carriage 5 in relation to the carriage 13.

Figure 5:
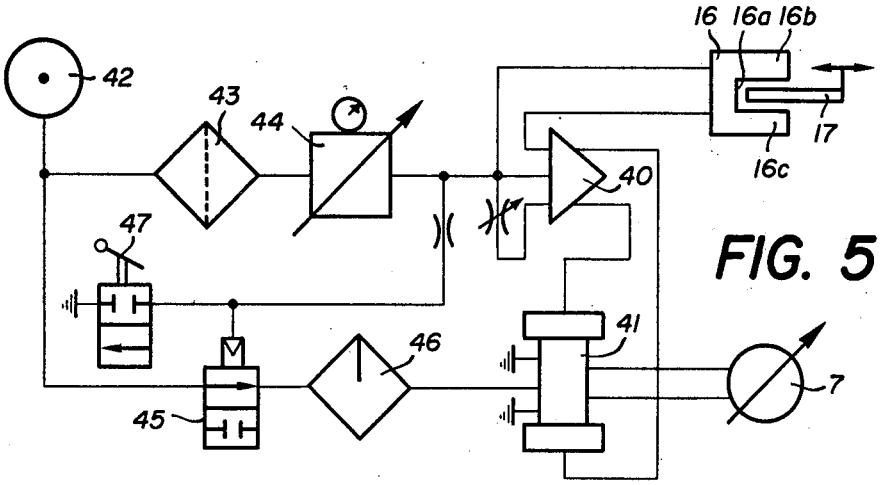
FIG. 5 is a control diagram for the block diagram of FIG. 4.

FIG. 5 shows the fluid control diagram used for processing the fluid signal obtained by means of the detector 16. The circuit comprises the detector 16 fed by a source of compressed air 42, a filter 43 and a pressure reducer 44. The pressure in the outlet lines of the detector 16 is amplified by the operational amplifier 40, the outputs of which are connected to the servo-valve 41. This latter is connected to the compressed air source 42 by way of a bistable valve 45 and a lubricator 46 which adds oil mist to the air. The bistable valve is connected to a control switch 47. The outputs from the analog servo-valve are connected to the variable speed pneumatic motor 7 which drives the worm 6.

Figure 2:
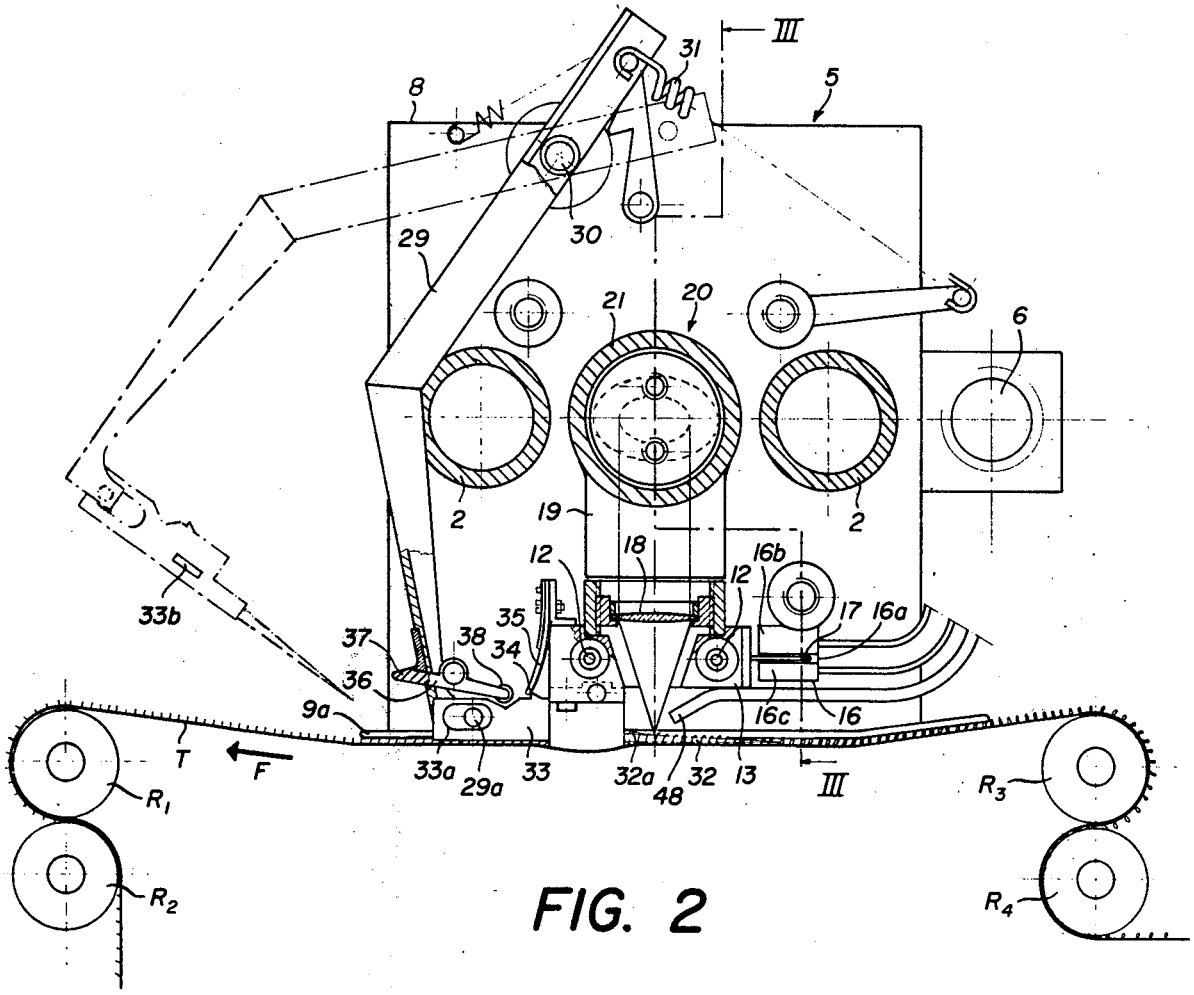
FIG. 2 is a more detailed sectional view, corresponding to a section along the line II—II of FIG. 1 or FIG. 3, illustrating features of the invention in an embodiment wherein reference numerals identical to those of FIG. 1 represent similarly functioning elements.

As shown in FIG. 2, the laser beam is concentrated by the lens 18 to form a spot directed on to the guide 32 when this is held in the working position by the bar 36. The guide 32 is designed to engage in a column of races of the fabric T, so that the races are brought with precision to the spot where the laser beam is concentrated almost instantaneously. The guide 32 remains in its working position as long as the pressure exerted in the direction of the arrow F resulting from the resistance of the columns of fabric races against the guide 32 is substantially balanced by the resistance of the reference spring 35. If this pressure increases, for example, due to damage to the guide or for any other reason, the force exerted in the direction of the arrow F increases suddenly and pushes the cam 33 in this direction. The follower 38 is then raised by the cam 33, and the arm 29, thus disengaged from the stop tooth 37, is pulled sharply by the spring 31 into the position shown by the dashed and dotted line. Conversely, if this pressure reduces, the reference spring 35 pushes the cam 33 in the direction opposite F and likewise raises the follower 38. The arm 29 is again disengaged from the stop tooth 37 and leaves the guide 32 of the race column.

While the fabric T moves fast under the shoes 8*a* and 9*a*, the guide 32 is subjected to lateral movements of variable amplitude and frequency. As the fabric passes by at a speed of the order of several meters per second, it is easy to understand that the column of races in which the guide is engaged undergoes lateral movements which could rang from some tenths of a millimeter to some centimeters. The purpose of the guide is to perfectly follow these movements. Because of the rigid connection between the second carriage 13 and guide 32, all the lateral movements of the guide 32 result in similar movements of the carriage 13. The inertia of this latter is chosen to be as low as possible so as not to offer even the smallest resistance to lateral movements. As the carriage 13 is rigid with the lens 18, and the laser beam rays encountering this lens are parallel, the laser spot constantly follows the guide 32 and consequently cuts the fabric races precisely, despite the lateral oscillations which it undergoes as it passes by. At the same time, the nozzle 48 feeds a jet of fluid, which may be air, water or a neutral gas. The purpose of this fluid is to evacuate the combustion gases which reduce the efficiency of the focused laser beam.

As a consequence of the movements of the carriage 13, the pressure transmitted by the detector 16 to the amplifier 40 varies proportionally, so that the amplified signal which appears at one or other of the outlets of the amplifier 40 moves the servo-valve 41 in one direction or the other proportionally to the signal value. Consequently, the pneumatic motor 7 (FIG. 1) is driven in one direction or the other at a speed proportional to the signal, and this motor movement is transmitted to the worm 6 and carriage 5.

The inertia of the circuit means that the motor 7 reacts only with a certain delay. Assuming that the carriage 13 is driven with an oscillating movement of small amplitude and at a frequency of the order of 20 to 50 Hz, for example, the carriage 5 remains practically immobile as its movement corresponds to the mean of the movements of the carriage 13. If the oscillation frequency reduces and the amplitude increases, the carriage 5 indeed moves but because of the delay, the amplitude of the movement is very small. In contrast, every movement of the carriage 13, however small it may be and providing it is not oscillating, is followed by an identical movement of the carriage 5. Because of this, the passage from one column of races to the neighboring column is rigorously followed by the carriage 5. This indicates why the springs 14 and 15 are optional, the carriage 13 being in any case centered by the fluid system.

It has been calculated that the power of the laser spot remains practically unchanged providing the relative movement between the mirror 23 and lens 18 does not exceed 2 millimeter in one direction or the other. As the optical system formed by the less 18 and guide 32 is rigid with the same mobile member, the carriage 13, the spot behaves exactly as if the fabric passed by without any lateral movement. The fluid control circuit for the carriage 5 guarantees that the distance between the axis of the beam of parallel rays reflected by the mirror 23 and the optical axis of the lens 18 does not exceed the aforementioned 2 millimeters, so that the power at the level of the laser spot is substantially constant.

The advantage of the two-carriage mechanism described lies in the fact that the rapid lateral oscillations of small amplitude are faithfully reproduced by the second carriage 13, whereby a filtering phenomenon is produced between the second carriage 13 and the carriage 5. As the laser beam is formed of parallel rays, as though the source was located at infinity, the relative movements between the mirror 23 and lens 18 have no infuence on the location of the spot but only on its power. However, the reduction in power is not significant providing the distance between the two carriages 5 and 13 does not exceed ±2 millimeters, which can be guaranteed. The laser used in this application is a $CO_2$ laser having a power of a few hundred watts, and an emitted wavelength of 10.6 microns. In the present example, the diameter of the beam of parallel rays emitted by the source of laser rays 26 is 8 millimeters. This beam traverses the first converging lens **39*a* of focal length F. The second converging lens 39*b* of focal length 2F, which is at a distance of 3*f* from the lens 39*a*, straightens the diverging beam to form a parallel beam of 16 millimeters diameter. The diameter of the spot d is notably inversely proportional to the diameter D of the beam concentrated by the lens 18**, d being represented by the equation:

$$d=2.44\lambda f/D$$

where λ(lambda) is the wavelength emitted by the laser 26 and f the focal length of the lens 18. It is thus desirable to increase the diameter of the beam concentrated by the lens 18 as much as possible within practical limits. The power obtained at the level of the spot is sufficient to increase the cutting speed to an order of magnitude several times greater than present speeds. In practice, other constraints evidently reduce this laser performance.

A blade **32*a* is provided on the guide 32 (FIG. 2) after the point of impact of the laser spot on the guide 32 with respect to the direction F of movement of the fabric T. This blade 32*a* is provided to cut any filaments which had not been cut by the laser rays. This blade is however optional. In one unrepresented modification, the laser spot could be made to shift laterally relative to the guide 32** by a distance equal to the distance between two neighboring columns of races.

Figure 3:
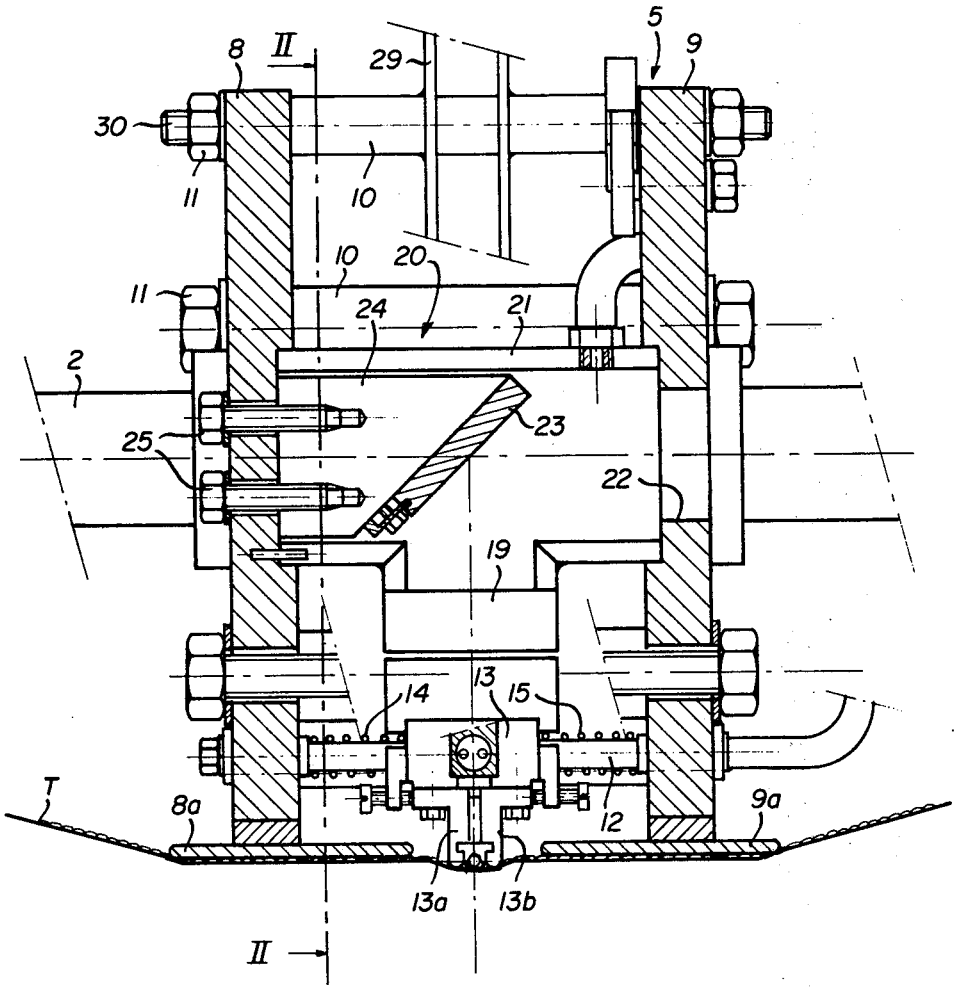
FIG. 3 is a view corresponding to a section along the line III—III of FIG. 2.

In the device illustrated in FIGS. 1 to 3, the beam axis is directed substantially perpendicular to the plane of the fabric T. Consequently, approximately 50% of the laser beam energy is lost because of the gaps separating the threads.

This lost proportion of energy could be considerably reduced by inclining the beam axis as shown in FIG. 6, which shows the guide 32 with the fabric races, and the lens 18 and mirror 23 which have been inclined through an angle about the lens focus, in a plane containing the guide 32. This device increases the time of passage of each thread through the focused laser beam by reducing by a like amount the time during which the beam falls in the gaps separating the threads.

FIGS. 7 and 8 show a device for carrying out the process according to the second method. There exist looms which simultaneously produce two fabric sheets $T_1$ and $T_2$ bonded to each other by a plurality of threads which are then cut to separate the sheets and form pile surfaces on each sheet. Velvets and certain types of carpets can be obtained by this process. The sheets may be separated either at the outlet of the loom or on a machine specially conceived for this purpose. FIGS. 7 and 8 show very diagrammatically a device which enables a laser to be used in such a case. The Figures show the sheets $T_1$ and $T_2$ firstly mutually parallel and then, after separation, mutually diverging to be wound on two storage rolls 51 and 52. The distance between the sheets $T_1$ and $T_2$ in the separation zone is defined very exactly by two rollers 53 and 54.

The laser 26 with its optical circuit is mounted absolutely identically to the manner shown in FIG. 1. The optical circuit terminates in a mirror 23' and a lens 18' carried by a carriage 55 slidably mounted on two rails 56 and 57 parallel to the rollers 53 and 54. The carriage 55 is connected to a drive mechanism comprising a motor 58 and a belt 59 held between the pulley 60 of the motor 58 and a pulley 61. A drive peg 62 is fixed under the carriage 55. This peg 62 is aligned with the axis joining the centers of the pulleys 60 and 61, and is engaged with a fork 63 rigid with the belt 59. This device enables the carriage 55 to be driven with a reciprocating movement, the trajectory of which is parallel to the trajectory of the laser beam, so that the line scanned by the point of focus of this beam is constantly kept between the rollers 53 and 54, so burning during its passage that portion of the threads joining the sheets $T_1$ and $T_2$ brought into contact with the beam almost instantaneously. Again, a nozzle 64 connected to a source of fluid (not shown), for example air, directs this fluid into the focus zone of the beam.

Figure 9:
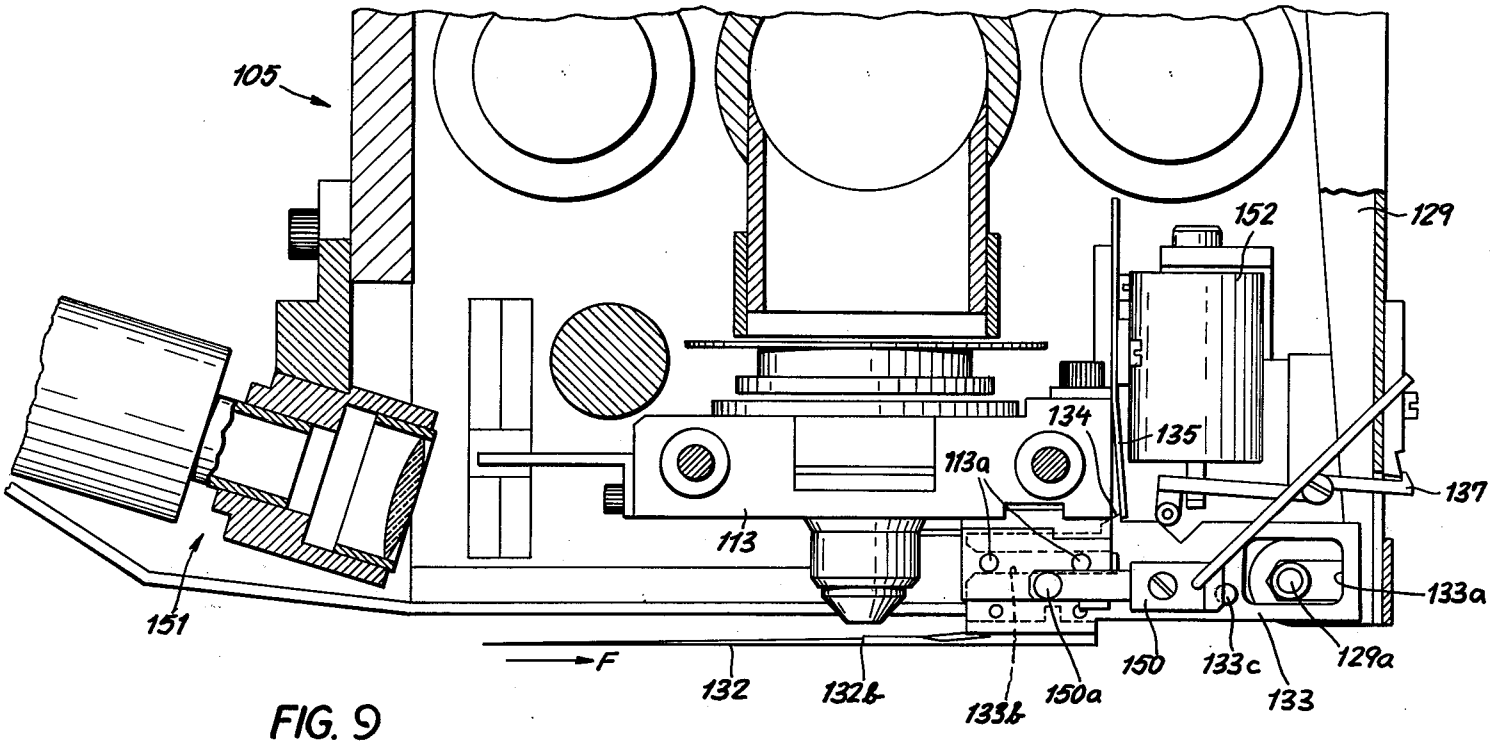
FIG. 9 is a view similar to FIG. 2 and illustrating another embodiment of the invention provided with a needle having hook means as previously described in general terms.
Figure 10:
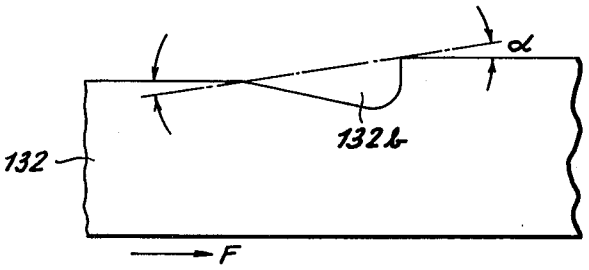
FIG. 10 is a detail view, drawn to an enlarged scale, of the hook region of the needle of FIG. 9.

In the device shown in FIGS. 9 and 10, the carriage 105, shown only partially in FIG. 9, is substantially the same as that illustrated and described for the carriage 5 discussed previously. The remainder of the device, to the extent that is also the same as the embodiments discussed previously, has not been illustrated nor is it described in detail. Only those points in which the system of FIGS. 9 and 10 differs from that of the earlier embodiments have been described in detail below.

The modifications of the device to yield the embodiment of FIGS. 9 and 10 reside essentially in the configuration of the guide needle 132 and its displacement.

FIG. 10 shows a portion of the needle 132, drawn to a greatly enlarged scale and having a hook portion **132*b* adapted to be mounted on a support carriage or slide 113 with precision at the focal point of the laser beam defined by a lens which is mounted upon this carriage 113**.

The guide 132, at least in the region of the hook portion **132*b***, is coated with a protective layer adapted to reduce the attack of the laser beam upon this guide.

This coating is preferably a layer of highly polished nickel, the guide being composed otherwise of steel. Good results are also obtained with a protective layer of chromium, preferably disposed upon a sublayer of copper, with a protective layer of rhodium on a sublayer of copper, or with a protective layer of platinum.

These coatings permit a significant increase in the resistance of the guide needle to the laser beam on the one hand by reflecting a part of the laser energy impinging upon this coating and, on the other hand, by conductively eliminating the heat generated.

The hook portion 132b is formed by a step in which the needle which is otherwise of monotonically (regularly) increasing thickness from its point in the direction of the arrow F, is subject to a marked increase in thickness as shown by the increased angle $\alpha$ in FIG. 10.

The hook portion thus is capable of engaging and retaining the floats which are displaced along the length of the guide 132 in the direction of the arrow F, the hook portion having a depth corresponding substantially to the thickness of the yarn of the loop to be engaged. The hook portion which receives the yarn is thus formed in part by a recess in the needle and by a significant increase in the thickness of the needle. Thus the hook portion 132b can be positioned exactly at the focal point of the laser beam and it is important to reduce as much as possible the weakening of the needle in this region. This is readily accomplished by increasing the thickness in the manner described.

The mounting of the guide needle 132 is effected by the intermediary of a disengagement cam 133 which differs somewhat from that which has been described previously in conection with FIG. 2.

In the embodiment of FIG. 2, the cam 33 is mounted longitudinally with a certain degree of freedom or play. A spring 35, dimensioned as a function of the normal force exercised by the fabric on the guide 32, retains this cam 33 yieldably against an abutment 34. As a result, the guide 32 is capable of undergoing a slight oscillating movement in the longitudinal direction. This movement is not always desirable.

In fact, when a recess 132b is provided (FIGS. 9 and 10), the point at which the thread loop is immobilized is always at the focal point of the laser and this location should be practically immovable during normal functioning conditions.

As opposed to the system in the previous embodiments in which the slide carrying the needle is released upon the application of any slight abnormal pressure, in the system to be described below, the guide acts against a spring and release is only effective when thread loops no longer reach the crotch of the hook portion 132b, or the needle pierces into the fabric.

In order to obtain these conditions, the cam 133 is mounted slidably in the carriage 113 by the intermediary of a groove 133b guided by two pins 113a. This cam 133 also carries an abutment 133c adapted to bear against (engage) a stopping lever 150 articulated about an axis 150a. The abutment 133c of the cam 133 is pressed against the lever 150 by the spring 135 and the spring engages the cam by a projection or abutment 134 on this cam 133. The stopping lever 150, which is an element not previously described, permits positioning the hook portion 132b of the needle 132 with great precision.

By contrast with the mode of operation for the embodiments previously described, this lever 150 renders the cam 133 and the spring 135 inoperative in the case where the force exerted by the fabric on the guide needle 132 approaches zero as a result of the withdrawal of this needle from the fabric. In order to permit the disengagement of the needle 132 in this latter case, the device is provided with an optical detector 151 having a lens whose focus is adjusted to coincide with that of the laser beam and also provided with a photoelectric cell.

An electromagnetic 152 is controlled by a circuit which can include a source of electric current (not shown) and an interrupter constituted by the photoelectric cell of the optical detector 151. The movable part (armature) of this electrical magnet 152 is connected to the locking pawl 137 of arm 129 and is intended to disengage this pawl 137 when the electromagnet 152 is energized.

In order to mount the guide needle 132 in place on the carriage 113, the needle is first fixed to the cam 133 in which it is locked. As in the case of the embodiments previously described, the cam 133 is connected to the arm 129 by a pin 129a of this arm received in an opening 133a of the cam 133 substantially larger than this pin.

The cam 133 is then fitted into the carriage 113 in engagement with the guide pins 113a so that the groove 133b receives these pins.

It is then necessary to raise the latching lever 150 in such manner as to push the cam 133 to enable the abutment 134 to engage the spring 135 and shift the same to the right. Thereafter, the cam 133 is retracted and the lever 150 is lowered to set (determine) the longitudinal position of guide 132 and of its hook portion 132b while the spring 135 is under tension. This tension (stress) is selected such that the force supplied by the spring is slightly greater than and opposite that produced by the engagement of the needle 132 with the fabric.

When the guide needle 132 is engaged in a column of thread loops of the fabric and the fabric is displaced so as to advance this column in the direction of the arrow F along and onto the needle, the successive thread loops or floats ride the length of the needle 132 while retaining their normal spacing within the fabric and produced during the weaving operation. When the floats arrive at the hook portion 132b, they have a tendency to accelerate down on the ramp running to the bottom of the recess forming the hook portion where they are suddenly arrested by the vertical flank of this hook portion (FIG. 2).

This arresting location is located precisely at the focal point of the laser beam. As a result the portion of the thread loops which is found at the bottom of the recess forming the hook portion 132b is burned away.

This acceleration into the crotch of the hook portion and the sudden stopping of the thread loop against the vertical flank thereof has the effect of causing the successive thread loops to close up upon one another and hence reduce or eliminate the spacing between the successive floats so that the cutting thereof proceeds from float to float without interruption of the engagement of the laser focus with a thread. In other words, the laser beam no longer falls directly upon the needle surface between thread loops and substantially all of the laser beam energy is used to sever the threads. Since the guide needle 132 is practically not subjected to laser energy, wear is significantly reduced or completely eliminated. The laser beam is thus employed practically continuously and no longer intermittently.

With the system of the invention, one can make use of the laser source of smaller power than with the embodiments previously described. Furthermore, the arresting and immobilization of the thread loops or floats on the guide needle contributes significantly to improving the efficiency of the cutting operation.

If the tip of the guide needle 132 pricks the fabric, the force exerted upon the needle increases instantaneously, displacing the needle 132 and the cam 133 against the force of spring 135, i.e. to the right in FIG. 9.

The latch 137, rocks to free the arm 129 which is actuated as described in connection with the previous embodiments for the arm 29, thanks to its restoring spring. Simultaneously with the disengagement of the needle, the laser beam is interrupted by electrically deenergizing it via switch means (not shown).

If, on the contrary, the tip of the guide needle 132 rises and passes thereby out of the column of floats with which it is engaged, the region of the hook portion **132*b* which is scanned by the optical detector 151 is no longer obstructed by the thread loops and the reflected laser beam energy picked up by the optical detector causes the electromagnet 152 to operate its armature and free the arm 129 by engagement of the latch 137**. Again, the laser beam is automatically interrupted.

In this latter case, since the laser beam energy can impinge directly upon the surface of the needle, the coating of the hook portion **132*b*** is of considerable significance in reducing the attack on this needle.

We claim:

1. An apparatus for the manufacture of a pile fabric by severing thread loops disposed parallel to one another in successive columns along one surface of a fabric web, said apparatus comprising:

means forming a cutting station and defining a cutting location;

means for relatively displacing said station and said web to advance the thread loops of each column successively to said location and displace the respective column past said location;

a guide needle engaged in the column of thread loops advanced toward said location and supporting each thread loop at said location;

a laser mounted at said station;

a focusing lens movably disposed at said station for focusing a beam from said laser on said location;

means coupling said needle to said lens and maintaining the zone of focus in said beam upon each loop disposed on said needle at said location, said guide needle being mounted upon a first carriage shiftable parallel to said web, said lens being mounted upon a second carriage shiftable on said first carriage parallel to the direction of displacement thereof; and means coupling said needle to said lens including means responsive to the movement of said second carriage for controlling the displacement of said first carraige.

2. The apparatus defined in claim 1, further comprising a support rigidly retaining said needle, said first carriage being provided with means for guiding said support substantially transversely to said columns.

3. The apparatus defined in claim 2 wherein said lens is disposed to focus said beam along an axis inclined toward the surface of said fabric and contained in a plane containing the guide needle and substantially perpendicular to the surface of said fabric and.

4. The apparatus defined in claim 2, further comprising means for directing a jet of fluid at the zone of focus of said laser beam to remove combustion products produced by combustion of a portion of thread loops disposed at said location.

5. The apparatus defined in claim 1 wherein said needle is formed with a hook portion at said location defining an abutment engageable by each thread loop and an inclined flank accelerating the following thread loops toward a thread loop positioned against said abutment whereby the thread loops at said locations are substantially in contact with one another and said beam impinges upon the successive thread loops substantially without encountering said needle.

6. The apparatus defined in claim 5 wherein said needle is mounted on a slider, said station further comprising spring means resiliently bearing on said slider against the force exerted thereon by movement of said thread loops along said needle, said slider being formed as a cam engageable by a cam follower, said slider being connected to an arm normally latched to retain said needle in its operative position, said cam follower releasing said arm upon operation by said cam.

7. An apparatus for the manufacture of a pile fabric by severing thread loops disposed parallel to one another in successive columns along one surface of a fabric web, said apparatus comprising:

means forming a cutting station and defining a cutting location;

means for relatively displacing said station and said web to advance the thread loops of each column successively to said location and displace the respective column past said location;

a guide needle engaged in the column of thread loops advanced toward said location and supporting each thread loop at said location;

a laser mounted at said station;

a focusing lens movably disposed at said station for focusing a beam from said laser on said location;

means coupling said needle to said lens and maintaining the zone of focus in said beam upon each loop disposed on said needle at said location, said needle being provided with a hook portion at said location defining an abutment engageable by each thread loop and an inclined flank accelerating the following thread loops toward a thread loop positioned against said abutment whereby the thread loops at said locations are substantially in contact with one another and said beam impinges upon the successive thread loops substantially without encountering said needle, said needle being mounted on a slider;

spring means resiliently bearing on said slider against the force exerted thereon by movement of said thread loops along said needle, said slider being formed as a cam engageable by a cam follower, said slider being connected to an arm normally latched to retain said needle in its operative position, said cam follower releasing said arm upon operation by said cam, said cam follower being provided on a lever; and electromagnetic means responsive to the reflection of light from said needle and the absence of a thread loop at said location for displacing said lever to unlatch said arm.

8. The apparatus defined in claim 7 wherein said needle is provided at said location with a protective coating highly reflective to said laser beam.

9. The apparatus defined in claim 8 wherein said protective coating is composed of polished nickel.

* * * * *